US005340292A

United States Patent [19]

Steele

[11] Patent Number: 5,340,292

[45] Date of Patent: Aug. 23, 1994

[54] SCROLL COMPRESSOR WITH RELIEF PORT FOR REDUCTION OF VIBRATION AND NOISE

[75] Inventor: Duane F. Steele, Onsted, Mich.

[73] Assignee: Ford Motor Company, Dearborn, Mich.

[21] Appl. No.: 29,867

[22] Filed: Mar. 11, 1993

Related U.S. Application Data

[63] Continuation-in-part of Ser. No. 826,111, Jan. 27, 1992, abandoned.

[51] Int. Cl.[5] ..... F04C 18/04

[52] U.S. Cl. ..... 418/55.1

[58] Field of Search ..... 418/14, 55.1, 55.5

[56] References Cited

U.S. PATENT DOCUMENTS

| | | | |
|---|---|---|---|
| 4,365,941 | 12/1982 | Tojo et al. | 417/372 |
| 4,432,708 | 2/1984 | Hiraga et al. | 418/55.1 |
| 4,545,747 | 10/1985 | Tamura et al. | 418/55.1 |
| 4,626,179 | 12/1986 | Terauchi | 418/55.5 |
| 4,645,437 | 2/1987 | Sakashita et al. | 418/55.5 |
| 4,696,627 | 9/1987 | Asano et al. | 418/55.1 |
| 4,993,928 | 2/1991 | Fraser, Jr. | 418/55.5 |
| 5,055,012 | 10/1991 | Sakashita et al. | 417/440 |
| 5,256,044 | 10/1993 | Nieter et al. | 418/55.5 |

FOREIGN PATENT DOCUMENTS

| | | | |
|---|---|---|---|
| 0350426 | 7/1989 | European Pat. Off. . | |
| 60-249685 | 12/1985 | Japan . | |
| 2-5781 | 1/1990 | Japan . | |
| 3225093 | 10/1991 | Japan | 418/55.1 |

*Primary Examiner*—John J. Vrablik

*Attorney, Agent, or Firm*—Roger L. May; Raymond L. Coppiellie

[57] ABSTRACT

A scroll compressor (10) comprising a stationary scroll member (12) including an end plate (14) and a stationary involute wrap (16) extending from the end plate (14), and a discharge port (18) defined within the end plate (14). The scroll compressor (10) has an orbiting scroll member (20) including an orbiting involute wrap (16) which is movable in cooperative relationship with the stationary involute wrap scroll (12) so that a pair of sealed pockets (26, 28) is formed therebetween, the volume of the sealed pockets (26, 28) being reduced as orbital motion progresses. A relief port (32) extends through the end plate (14), in communication with one of the sealed pockets (26, 28) and a suction chamber so that at any given point of orbital motion, there is a pressure imbalance between pockets in the pair of sealed pockets (26, 28), and a consequent diminution in noise and vibration of the scroll compressor (10).

17 Claims, 4 Drawing Sheets

SCROLL COMPRESSOR WITH RELIEF PORT FOR REDUCTION OF VIBRATION AND NOISE

CROSS-REFERENCE TO RELATED APPLICATION

This application is a continuation-in-part of copending patent application Ser. No. 826,111, filed Jan. 27, 1992, abandoned, also entitled "Scroll Compressor With Relief Port For Reduction Of Vibration And Noise," and which is hereby incorporated by reference.

TECHNICAL FIELD

The present invention relates to a scroll compressor for use in a refrigeration system, such as an air conditioner. More particularly, the present invention relates to a scroll compressor including a relief port which causes a pressure imbalance between a gaseous medium confined by sealed pockets disposed within the compressor, together with a consequent diminution of noise and vibration.

BACKGROUND ART

Scroll compressors are increasingly used to compress gasses in energy-efficient residential heat pumps and in refrigeration systems such as air conditioners. Uses of scroll compressors include their application in vacuum pumps, pumps for various gases, gas expanders, and engine blowers.

In such compressors, there is a stationary scroll member having an end plate and an involute or spiral wrap extending therefrom. A discharge port is typically defined within the end plate. Disposed in intermeshing relationship with the stationary scroll is an orbiting scroll, which also extends from an end plate. The orbiting scroll member is operatively connected to a driving shaft by a short-throw crank mechanism so that any given point on the orbiting scroll member describes an orbital trajectory in relation to a given point on the stationary scroll member.

The two scroll members are phased 180° apart, i.e., one is a mirror image of the other. During relative motion between the stationary and orbiting scroll members, sealed pockets are formed between intermeshing involute scrolls, within which the gas to be compressed is confined. As orbital motion progresses, the sealed pockets undergo a reduction in volume. As a result, the sealed pockets act as compression chambers while the entrapped gas undergoes progressive confinement.

In such compressors, suction refrigerant gas enters the stationary and orbiting scroll members at their outer periphery. The meshing of the scrolls forms crescent-shaped pockets, which, starting from the periphery, reduce in size, thereby increasing the pressure of the trapped gas. The outermost pockets which are initially open to a suction chamber are sealed off as the orbiting scroll member touches the outside end of the fixed scroll member. The closed pockets move radially inward until they coalesce in communication with the discharge port, resulting in the expulsion of gas under high pressure.

The scroll compressor is unidirectional. It functions as a compressor when rotated in one direction, and as an expander when rotated in the opposite direction.

By controlling the number of wraps on the scroll members and the location of the discharge port, an optimum pressure ratio is established for a given compressor. Performance levels for such compressors also depend on the control of leakage.

As mentioned above, the pressure of refrigerant gas in the sealed pockets increases as their volume between the end plates is reduced by motion of the orbiting scroll in relation to the stationary scroll member. Entrance of the gas into a sealed pocket occurs through an intake passage before it is progressively compressed by a swirling motion of the scroll members. Entrapped gas is urged thereby toward the center of the scroll compressor. As the confined gas approaches the center, the sealed pockets converge further, while the gas is compressed even more. Proximate the center, the compressed gas escapes through the discharge port, from which it is guided into such external equipment as a condenser. From such external equipment, the compressed gas returns to an intake side of the compressor before the normal compression cycle is repeated.

Eccentric mounting of the orbital scroll member upon the driving shaft usually produces concomitant noise and vibration. In the past, problems of noise and vibration have been approached by multiplying the number of release ports. Illustrative of such approaches is Japanese patent application publication no. 2-5781 which bears a patent publication date of Jan. 10, 1990. That reference discloses the provision of multiple release ports at specified places on the stationary scroll member. Some loss of efficiency is incurred in such designs. Another approach, such as that disclosed in U.S. Pat. No. 4,626,179 which issued on Dec. 2, 1986 involves configuring the orbiting scroll member in relation to the fixed scroll member so that their respective lengths differ. As a result, gas pressure distribution within the fluid pockets is asymmetrical. This results in a larger moment of rotation for the orbiting scroll member, which is said to reduce vibration and noise. The disclosure of U.S. Pat. No. 4,626,179 is incorporated herein by reference.

The overall scroll wrap length is significant from a manufacturing viewpoint. Wrap length determines the manufacturing time required for machining each scroll wrap, which is one of the dominant cost (and productivity) factors.

In light of such problems, it would be desirable to reduce noise and vibration without increasing the number of release ports unnecessarily and without using different lengths of stationary and orbiting scrolls. Accordingly, the need has arisen to solve noise and vibration problems by delaying the initiation of compression in one sealed pocket in relation to another sealed pocket for reasons to be discussed below. The solution to such problems enables compressors to be produced which are more energy-efficient, lighter, and smaller than their predecessors.

SUMMARY OF THE INVENTION

One of the objects of the present invention is to provide a scroll compressor in which an orbiting scroll member intermeshes with a stationary scroll member without significant noise or vibration.

A further object of the present invention is to provide a scroll compressor which is simple in construction and does not require numerous discharge ports or different lengths in the involute scrolls of stationary and orbiting scroll members.

Another object of the present invention is to provide a scroll compressor in which noise and vibration problems are solved, regardless of absolute pressure of the gas which enters the compressor.

The above and other objects of the present invention are accomplished by providing a scroll compressor wherein a single relief port is provided which extends through an end plate from which either the rotary or orbiting scroll members extend. The relief port is in communication with one of the sealed pockets defined by the intermeshing action of involute scrolls between the stationary and orbiting members and a suction chamber for introduction of gas into the compressor. At any given time during orbital motion, there is a pressure imbalance between sequential sealed pockets because the onset of compression is delayed in one sealed pocket in relation to its paired counterpart. As a result, there is an asymmetrical gas pressure distribution within the sealed pockets, thereby producing a larger moment of rotation of the orbiting scroll. Consequently, problems of noise and vibration of the scroll compressor are abated.

DESCRIPTION OF PREFERRED EMBODIMENTS

The basic structure of a scroll compressor includes five major components: a stationary scroll member, an orbiting scroll member, an anti-rotation coupling, a driving shaft, and a crank case. For simplicity and clarity, this description and the accompanying drawings will focus primarily on the stationary and orbiting scroll members.

Figure 1:
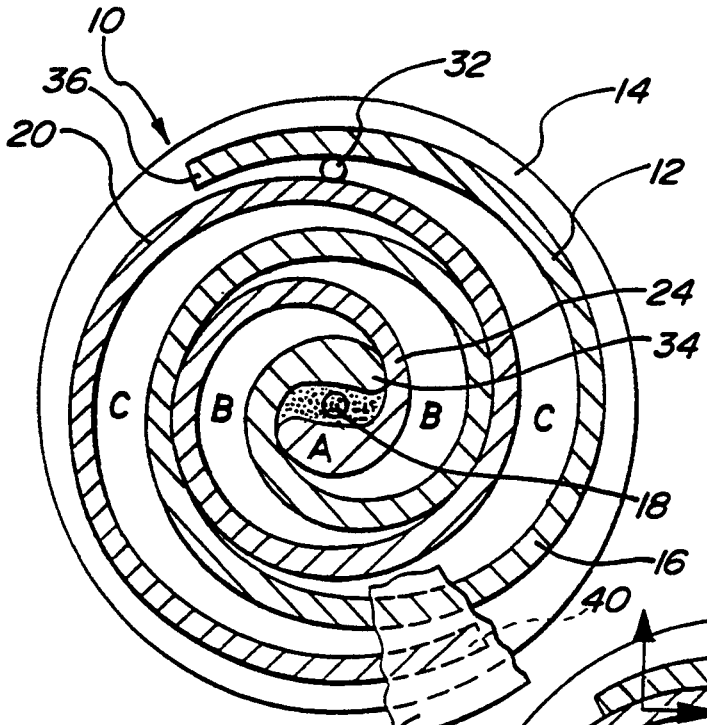
FIG. 1 is a schematic view illustrating the positioning of intermeshing involute elements of orbiting and stationary scroll members in a scroll compressor disclosed by the present invention at the onset of a compression cycle.

In FIG. 1 of the drawings, there is depicted a scroll compressor 10 which comprises a stationary scroll member 12 including an end plate 14. Extending from the end plate 14 is a stationary involute wrap 16. Compressed refrigerant gasses are expelled from the scroll compressor 10 through a discharge port 18 defined within the end plate 14. Incoming refrigerant gas from the system enters via a gas inlet 13, as shown in FIGS. 6–9, in communication with a suction chamber 21. Gas emerges from scroll compressor 10 via discharge tube 44. It is understood that discharge tube 44 may be located on scroll compressor 10 in any conventional manner.

Nested within the stationary scroll member 12 is an orbiting scroll member 20, which also includes an end plate 22. For clarity, only a fragmented piece of the overlying orbital end plate 22 is depicted in FIG. 1. Extending from the orbiting end plate 22 is an orbiting involute wrap 24 which is movable in cooperative relationship with the stationary involute wrap 16 of the stationary scroll member 12. Relative motion between the stationary 12 and orbiting 20 scroll members form sealed pockets such as those represented by the letter "C" (FIG. 1). As orbital motion proceeds, the volume of the gas of the sealed pockets C is progressively reduced as orbital motion progresses.

Figure 5:
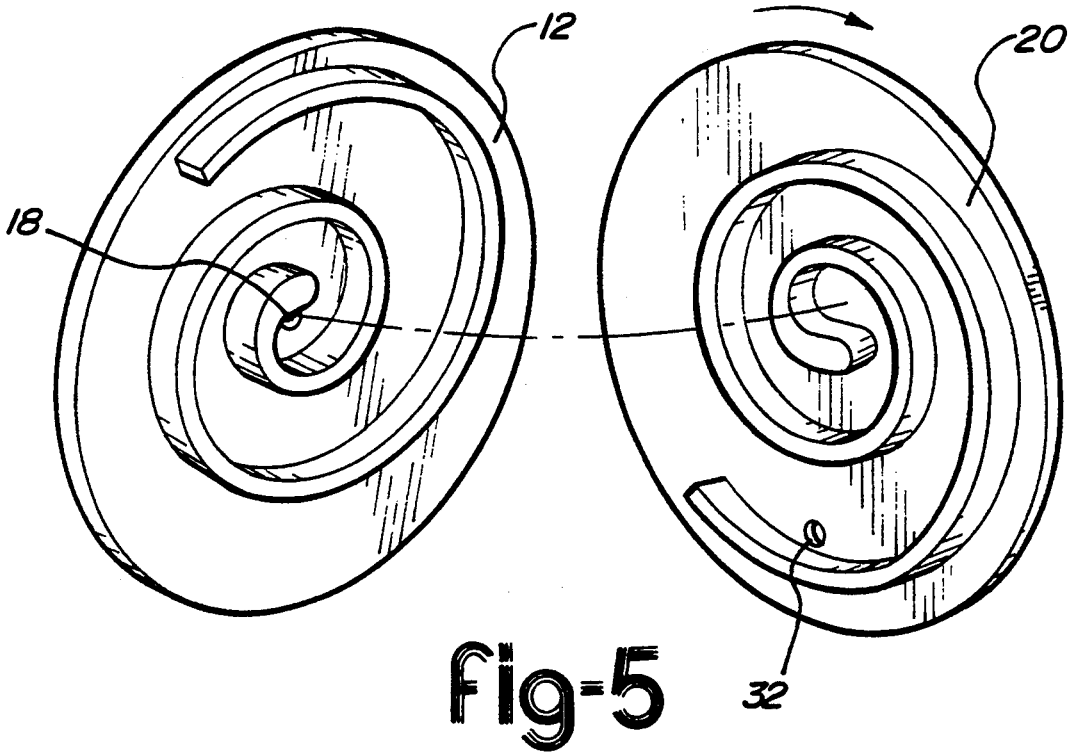
FIG. 5 is an exploded perspective view, illustrating the stationary scroll and the orbiting scroll with an oval relief port.
Figure 8:
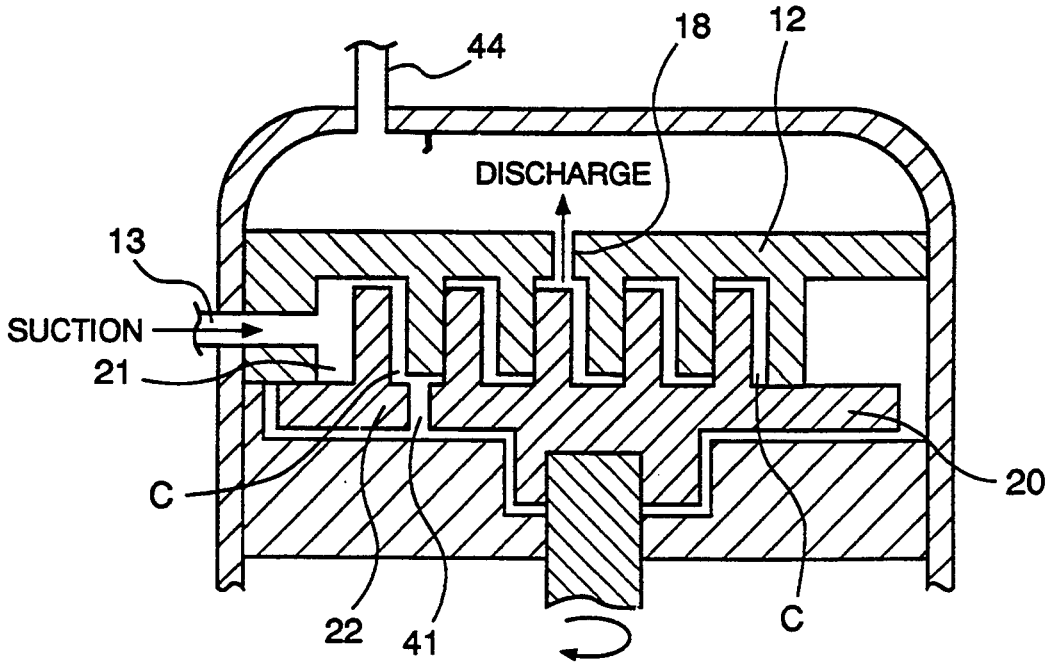
FIG. 8 is a fragmented cross-sectional view illustrating a relief port in the end plate of the orbiting scroll member.

Continuing with reference to FIG. 1, there is depicted a relief port 32. While the relief port 32 is depicted as being defined within the end plate 14 of the stationary scroll member 12, it should be realized that the relief port 32 could alternatively be defined within the end plate 22 of the orbiting scroll member 20 as illustrated in FIGS. 5 and 8.

Referring now to FIGS. 1–3 and FIG. 6, the relief port 32 is in communication with one of the pockets C, which is one in the pair of sealed pockets C defined between the stationary 16 and orbiting 24 involute wraps. Other pairs, such as those depicted by the reference letter B, are also formed within the orbiting and stationary scroll members 12, 20. The effect of the relief port 32 is to delay the onset of compression, so that the pressure in the sealed pocket C on the right-hand side of FIG. 1 is less than the sealed pocket C on the left-hand side of FIG. 1. Specifically, a portion of the gas initially drawn in sealed pocket C (right-hand side of FIG. 1) escapes through relief port 32 to suction chamber 21. This pressure imbalance created by the difference in the volumes of gas trapped in sealed pocket on the right-hand side and sealed pocket on the left-hand side generates a larger moment of rotation of the orbiting scroll member 20, with a consequent diminution of noise and vibration within the scroll compressor 10.

As a point of reference, the configuration of FIG. 1 has been arbitrarily designated as a 270° point in the orbital motion of the orbiting scroll member 20 in relation to its stationary counterpart 12. The members 12, 20 mate to form a series (e.g. B, C) of paired, symmetric, crescent-shaped sealed pockets. Incoming refrigerant gas to be compressed is introduced simultaneously adjacent an outer end 36 of the stationary scroll member 12 and at a diametrically opposed port adjacent the outer end 40 of the orbiting involute wrap 24 from suction chamber 21. Suction chamber 21 extends around the outer portions of the orbiting scroll member 20 and stationary scroll member 12. As the orbiting scroll member 20 moves, the pockets C become subjected to a progressive diminution in volume, together with displacement toward the center of the scroll compressor 10 and the discharge port 18.

Figure 2:
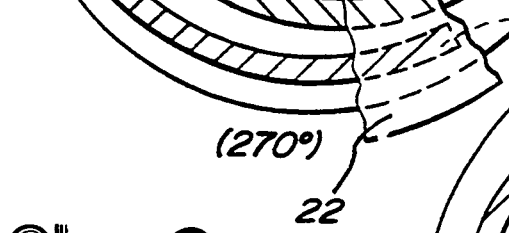
FIG. 2 is a schematic view illustrating the intermeshing scroll members at a later stage of the compression cycle.
Figure 3:
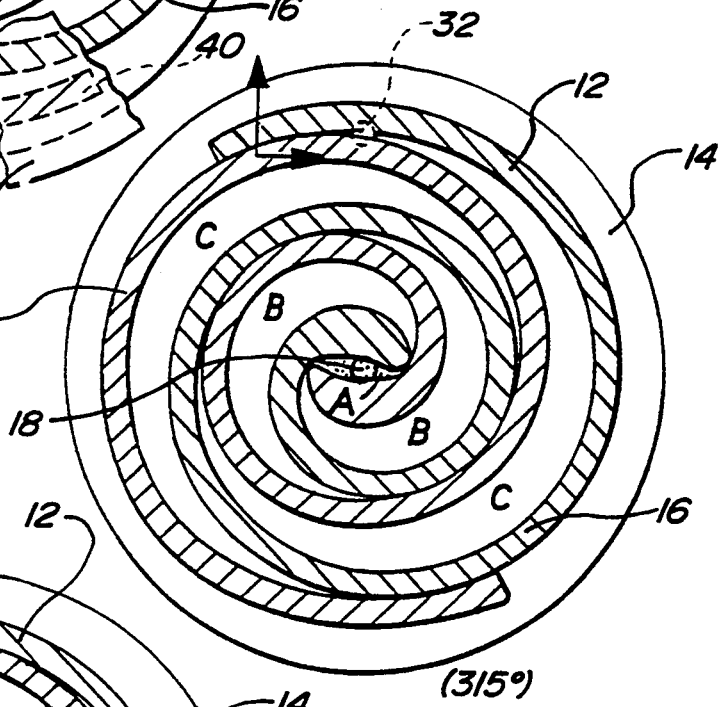
FIG. 3 is a schematic view illustrating a still further advanced point in the compression cycle.
Figure 3:
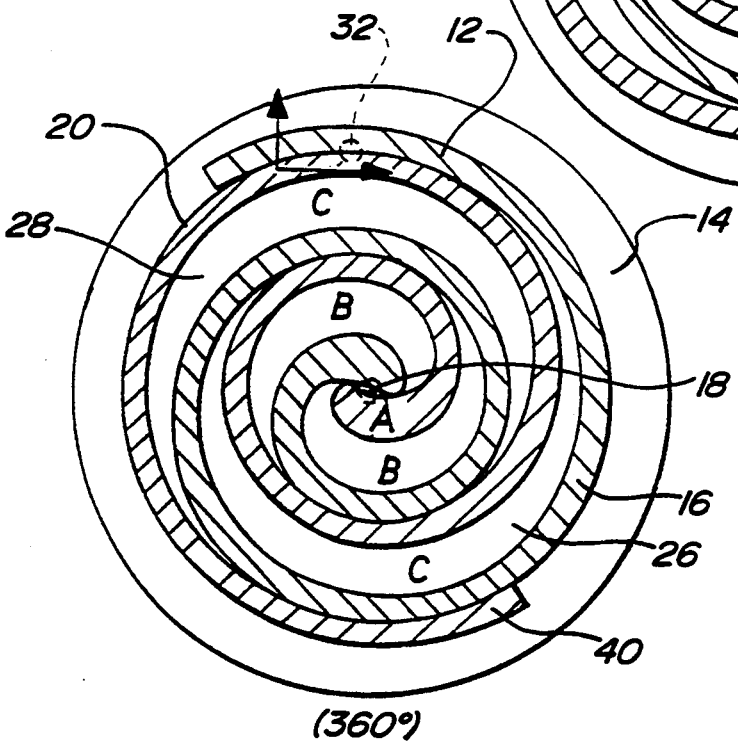

FIGS. 2–3 depict progressive stages, at 315° and 360° of subsequent orbital motion. At the center A of the scroll compressor 10, the pressurized pockets are merged together and expelled through the discharge port 18. In general, 1½ to 3 rotations of the driving shaft are required to transform the refrigerant gas from a suction to a discharged condition.

As noted earlier, the two scroll members 12, 20 are generally defined by the involutes of circles. The involutes are assembled with a 180° phase difference. Typically, the stationary scroll member 12 is attached to the crank case, while the orbiting scroll member 20 orbits by means of a driving shaft. The anti-rotation coupling is accomplished typically by an Oldham ring, which permits the orbiting scroll member 20 to orbit in one direction.

Turning back to FIG. 1, it can be seen that the stationary involute wrap 16 includes an outer end 36 and an inner end 34. As shown, the relief port 32 extends through the end plate 14 proximate the outer end 36 of the stationary involute wrap 16.

FIG. 3 depicts the relative positions of the stationary and orbiting scroll members 12, 20, which progressively eclipse the relief port 32. At 315° (FIG. 2), the eclipse is partial. In FIG. 3, the eclipse of the relief port 32 at the 360° point is complete. The effect of progressive occlusion of the relief port 32 is to delay the onset of compression in one sealed pocket C in relation to the other sealed pocket in the pair. As a result, the onset of compression is effectively delayed by about 15°–20° of rotation.

Figure 4:
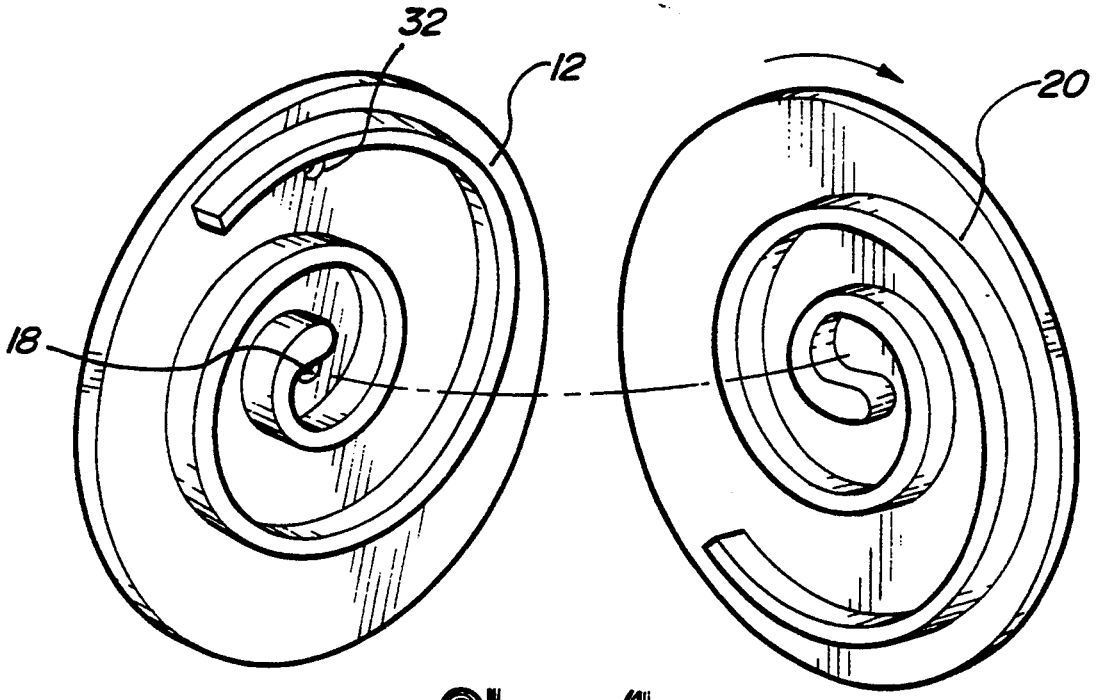
FIG. 4 is an exploded perspective view, illustrating an orbiting scroll, and a stationary scroll with a circular relief port.

FIGS. 1–3 illustrate a single relief port 32. In general, the relief port 32 is circular in cross-section (FIG. 4) and is of sufficient size to provide the desired slight pressure differential between the sealed pockets C. Alternatively, the relief port 32 may be configured in an oval or other shapes as shown in FIG. 5. For clarity, oval relief port 32 is exaggerated in FIG. 5. In each case, however, the relief port 32 is defined within the associated end plate 14 or 22 proximate the periphery thereof, but within the end of the outer end 36 or 40 of the associated scroll member 12 or 20.

Figure 6:
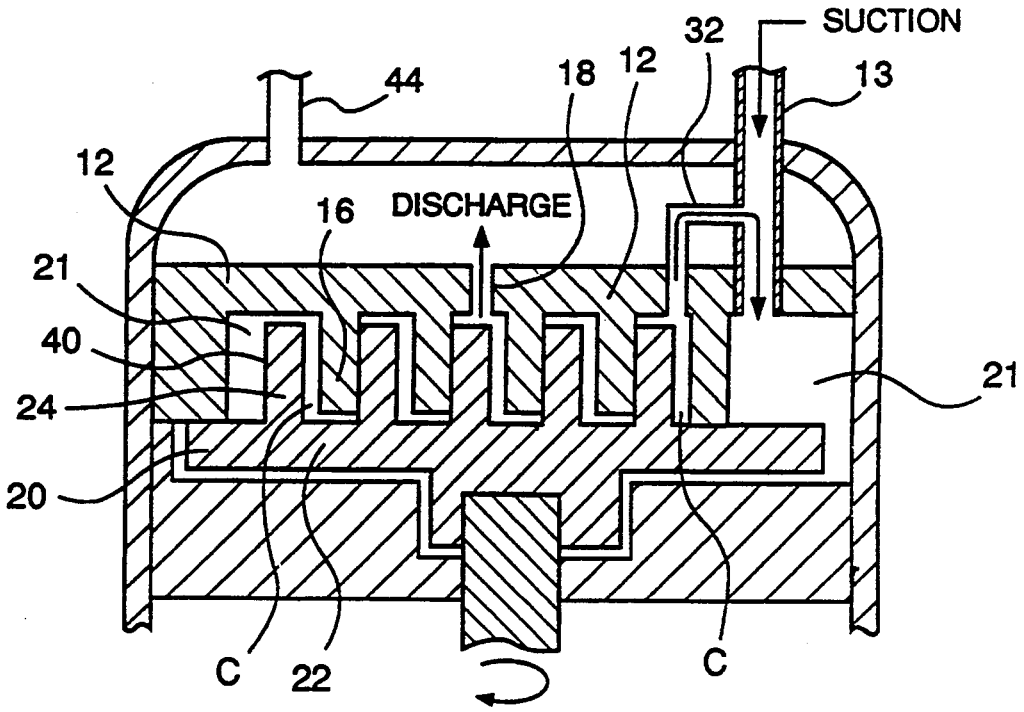
FIG. 6 is a fragmented cross-sectional view illustrating a relief port in the end plate of the stationary scroll member.

The effect of the desired pressure differential can readily be understood by inspection of, for example, FIGS. 3 and 6. Consider the sealed pockets C which are designated by the reference numerals 26, 28. Refrigerant gas enters into the scroll compressor 10 into the sealed pockets 26, 28 at the same time. Refrigerant gas particles enter the sealed pocket 28 past the outer end 40 of the orbiting scroll member 20 from suction chamber 21. Such gas particles have not been exposed to the relief port 32. At the same time as such gas particles enter the pump past the outer end 40, other gas particles enter the pump past outer end 36 (FIG. 1) of the stationary scroll member 12 at a diametrically opposed part of the scroll compressor 10. As orbital motion proceeds, gas in the sealed pocket 26 has been in communication with the relief port 32. As a result, some of the gas in the sealed pocket 26 has escaped to suction chamber 21. Consequently, the pressure in the sealed pocket 26 is slightly less than the pressure in sealed pocket 28. Accordingly, the mass of gas in sealed pocket 28 is greater, and effectively induces a larger moment of rotation in the orbiting scroll member 20. As a result, vibration problems are diminished, and attendant noise levels are reduced.

Figure 7:
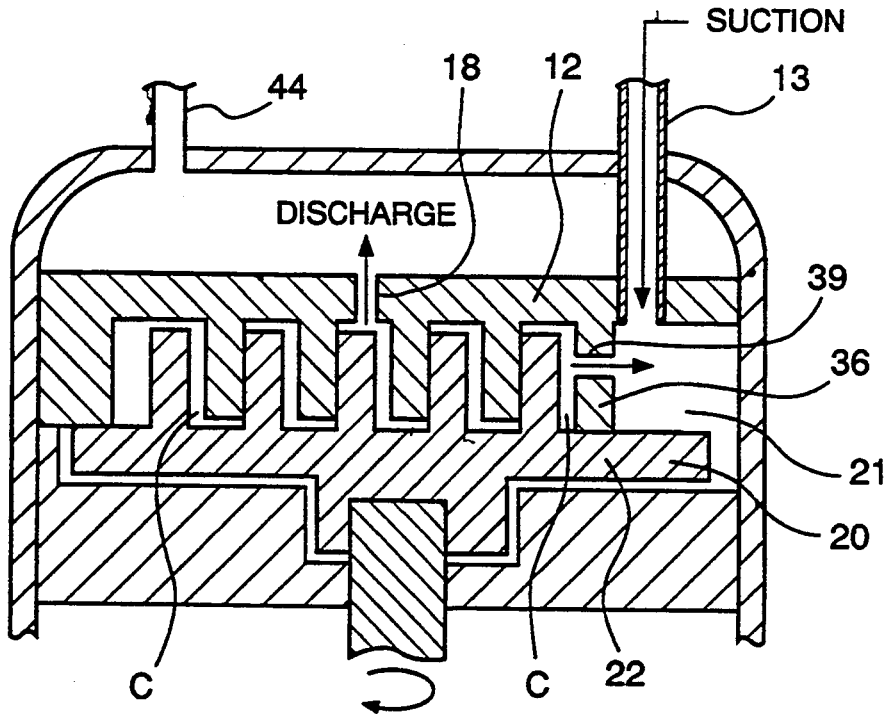
FIG. 7 is a fragmented cross-sectional view illustrating a relief port in the involute wrap of the stationary scroll member.

The preferred embodiment of the present invention is illustrated in FIG. 7. A transverse relief port 39 is shown disposed within stationary wrap outer end 36. Relief port 39 is positioned obliquely in relation to the surface of the involute wrap outer end 36. The relief port is in communication with one of the sealed pockets in the pair C and suction chamber 21. As orbiting scroll member 20 moves in relation to stationary scroll member 12, relief port 39 delays the onset of compression, as explained above. A pressure imbalance is created by the different volumes of the fixed mass of gas trapped in the sealed pockets. This pressure imbalance increases the moment of rotation of the orbiting scroll member, with a consequent diminution in noise and vibration.

Figure 9:
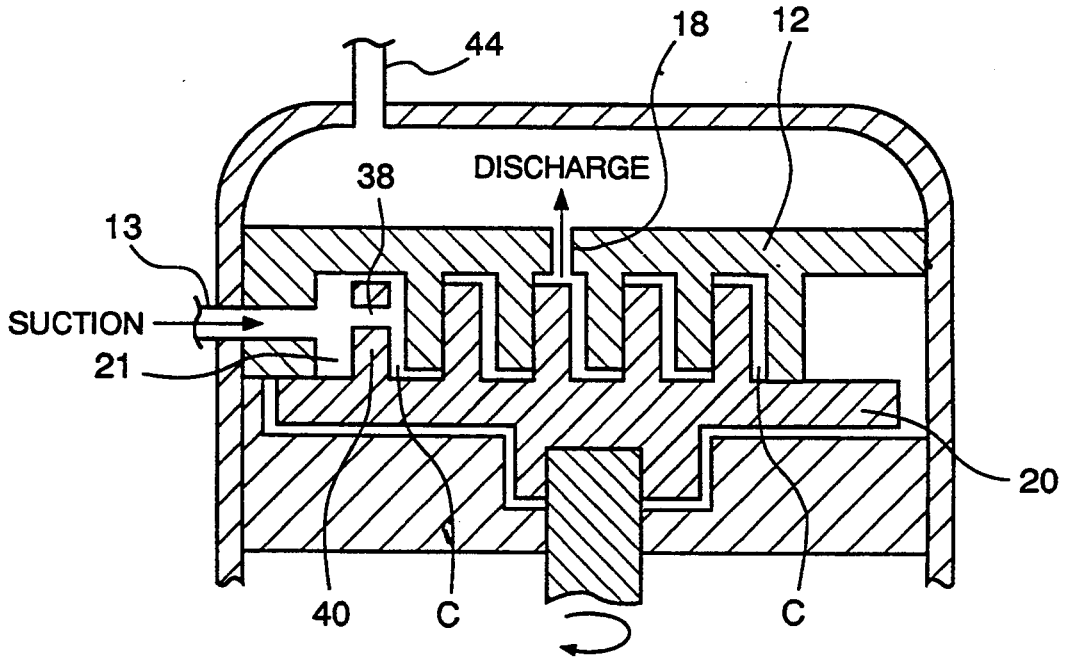
FIG. 9 is a fragmented cross-sectional view illustrating a relief port disposed in the involute wrap of the orbiting scroll member.

FIGS. 8–9 further disclose alternative embodiments of the present invention, wherein the relief port is disposed at various positions within the orbiting scroll. FIG. 8 discloses a relief port 41 disposed in the end plate 22 of the orbiting scroll 20. The relief port, as shown, is in communication with suction cavity 21.

FIG. 9 is another alternative embodiment of the present invention, showing relief port 38 disposed in involute wrap outer end 40 of the orbiting scroll member. Relief port 38 is in communication with suction chamber 21.

Thus, there has been disclosed a scroll compressor 10 in which an orbiting scroll member 20 intermeshes with a stationary scroll member 12 without significant noise or vibration. The scroll compressor 10 is simple in construction and does not require numerous relief ports or different lengths in the involute scrolls of stationary and orbiting scroll members 12, 20. Additionally, the disclosed scroll compressor abates noise and vibration problems, regardless of absolute pressure of the refrigerant gas which enters the scroll compressor 10.

While the best mode for carrying out the invention has been described in detail, those familiar with the art to which this invention relates will recognize various alternative designs and embodiments for practicing the invention as defined by the following claims.

I claim:

1. A scroll compressor comprising:

a stationary scroll member including an end plate, a stationary involute wrap extending from the end plate, and a discharge port defined within the end plate;

an orbiting scroll member including an end plate, and an orbiting involute wrap extending therefrom, the orbiting involute wrap being movable in cooperative relationship with the stationary involute wrap of the stationary scroll member so that a pair of sealed pockets is formed therebetween, the volume of the pair of sealed pockets being reduced as orbital motion progresses;

a suction chamber in communication with said pair of sealed pockets;

a gas inlet for introducing a gas into said suction chamber; and a relief port in communication with one of the pockets in the pair thereof and said suction chamber so that there is produced a pressure imbalance between pockets in the pair and a diminution in noise and vibration of the scroll compressor.

2. The scroll compressor of claim 1 wherein the stationary involute wrap includes an outer end, the relief port extending through the associated end plate proximate the outer end of the stationary involute wrap.

3. The scroll compressor of claim 1 wherein the orbiting involute wrap includes an outer end, the relief port extending through the associated end plate proximate the outer end of the orbiting involute wrap.

4. The scroll compressor of claim 1 wherein the relief port extends through the orbiting involute wrap.

5. The scroll compressor of claim 1 wherein the relief port extends through the stationary involute wrap.

6. The scroll compressor of claim 1 wherein the relief port comprises a single relief port.

7. The scroll compressor of claim 1 wherein the relief port is circular in cross-section.

8. The scroll compressor of claim 1 wherein the relief port is oval in cross-section.

9. The scroll compressor of claim 1 wherein the end plate associated with the stationary scroll member is defined by a periphery, the associated relief port being located proximate the periphery within the outer end of the stationary involute wrap of the stationary scroll member.

10. The scroll compressor of claim 1 wherein the end plate associated with the orbiting scroll member is defined by a periphery, the associated relief port being located proximate the periphery within the outer end of the orbiting involute wrap of the orbiting scroll member.

11. A scroll compressor comprising:

a stationary scroll member including an end plate, a stationary involute wrap extending from the end plate, and a discharge port defined within the end plate;

an orbiting scroll member including an end plate, and an orbiting involute wrap extending therefrom, the orbiting involute wrap being movable in cooperative relationship with the stationary involute wrap of the stationary scroll member so that a pair of sealed pockets is formed therebetween, the volume of the pair of sealed pockets being reduced as orbital motion progresses;

a suction chamber in communication with said pair of sealed pockets; and a relief port in communication with one of the pockets in the pair thereof so that there is produced a pressure imbalance between pockets in the pair and a diminution in noise and vibration of the scroll compressor, wherein the relief port extends through the orbiting involute wrap.

12. The scroll compressor of claim 11 wherein the relief port is circular in cross-section.

13. The scroll compressor of claim 11 wherein the relief port is oval in cross-section.

14. The scroll compressor of claim 11 wherein the orbiting involute wrap includes an outer end, the relief port extending through the associated end plate proximate the outer end of the opening involute wrap.

15. A scroll compressor comprising:

a stationary scroll member including an end plate, a stationary involute wrap extending from the end plate, and a discharge port defined within the end plate;

an orbiting scroll member including an end plate, and an orbiting involute wrap extending therefrom, the orbiting involute wrap being movable in cooperative relationship with the stationary involute wrap of the stationary scroll member so that a pair of sealed pockets is formed therebetween, the volume of the pair of sealed pockets being reduced as orbital motion progresses;

a suction chamber in communication with said pair of sealed pockets; and a relief port in communication with one of the pockets in the pair thereof so that there is produced a pressure imbalance between pockets in the pair and a diminution in noise and vibration of the scroll compressor, wherein the relief port extending through the stationary involute wrap.

16. The scroll compressor of claim 15 wherein the relief port is circular in cross-section.

17. The scroll compressor of claim 15 wherein the relief port is oval in cross-section.

* * * * *